United States Patent [19]

Tenner

[11] Patent Number: 4,765,583

[45] Date of Patent: Aug. 23, 1988

[54] LAP DESK

[76] Inventor: Wanda C. Tenner, 11320 E. 44th Ave., Spokane, Wash. 99206

[21] Appl. No.: 89,158

[22] Filed: Aug. 25, 1987

[51] Int. Cl.[4] ..... A47B 97/04

[52] U.S. Cl. ..... 248/444; 108/43

[58] Field of Search ..... 248/441.1, 444, 450, 248/451, 452, 453, 460, 461; 281/1; 312/231, 233; 108/25, 32, 43

[56] References Cited

U.S. PATENT DOCUMENTS

| | | | |
|---|---|---|---|
| 544,684 | 8/1895 | Parker | 248/444 X |
| 1,613,440 | 1/1927 | Carek | 248/444 X |
| 2,640,747 | 6/1953 | Bodenhoff | 248/444 |
| 2,701,173 | 2/1955 | Senior et al. | 248/444 X |
| 2,876,022 | 3/1959 | Kroviak | 248/444 X |
| 3,361,091 | 1/1968 | Inman | 248/444 X |
| 3,463,438 | 8/1969 | Olson | 248/444 |
| 3,991,966 | 11/1976 | Breer | 108/43 X |
| 4,243,249 | 1/1981 | Goss | 281/1 |
| 4,700,634 | 10/1987 | Mills | 108/43 |

*Primary Examiner*—J. Franklin Foss

*Attorney, Agent, or Firm*—Jerry T. Kearns

[57] ABSTRACT

A lap desk for use by children while traveling in an automobile has a box-like frame. The desk has a door which forms a compartment for storage of paper, coloring books, etc. and a separate compartment designed for storage of markers and crayons. A circular upstanding holder is designed as a receptacle for beverage containers. The lap desk is attached to a seat belt by straps, and is placed over the child's legs. A strap from the desk extends beneath the child's legs to secure the lap desk during use. An optional pad snaps to the bottom surface of the desk and may be provided with a curvature to receive the legs of a child.

1 Claim, 2 Drawing Sheets

LAP DESK

BACKGROUND OF THE INVENTION

1. Field of the Invention

The present invention relates to lap desks, and more particularly pertains to a new and improved lap desk for use by children while riding in automobiles. When children are traveling in automobiles for extended periods of time, they become restless and irritable. Many different devices have been developed to provide children with amusement while riding in an automobile. One of the favorite activities of small children is drawing and coloring. However, while riding in a car, it is difficult to maintain a flat, stable writing surface to permit a small child to draw and color. Also, any device which is utilized in an automobile, and is not secured, will become a projectile in the event of a collision. The present invention is directed to the provision of a lap desk which provides facilities for the amusement of small children, and yet is safely secured during use.

2. Description of the Prior Art

Various types of trays for use in vehicles are known in the prior art. A typical example of such a tray is to be found in U.S. Pat. No. D. 163,954, which issued to S. Kulwin on July 17, 1951. This patent discloses a tray for use on a dashboard of an automobile. U.S. Pat. No. D. 186,368, which issued to W. Brown on Oct. 20, 1959, discloses a tray and storage container for automobiles. U.S. Pat. No. D. 276,201, which issued to M. Wolff on Nov. 6, 1984, discloses a tray having a plurality of subdivided, recessed compartments. U.S. Pat. No. 3,606,112, which issued to L. Cheshier on Sept. 20, 1971, discloses a retractable beverage holder designed to be mounted under the dash of an automobile. The retractable beverage holder has a plurality of apertures for holding beverage containers. The beverage holder slides in a drawer like fashion, beneath the dash when not in use. U.S. Pat. No. 3,877,603, which issued to H. Holz on Apr. 15, 1975, discloses a tray designed for use in serving meals on aircraft. A frame having a plurality of subdivided apertures is provided with removable receptacles designed to be received in these apertures. Thus, individual food containers may be used with the basic frame of the tray, and discarded after each use. The basic frame of the tray is a reusable item.

While the above mentioned devices are suited for their intended usage, none of these devices provides a lap desk for use by small children in an automobile. Further, none of these devices provides a suitable securement whereby the tray is safely secured during usage. Also, none of these prior art trays is provided with a removable pad on the bottom surface. Inasmuch as the art is relatively crowded with respect to these various types of trays for use in vehicles, it can be appreciated that there is a continuing need for and interest in improvements to a lap desk for use by children in vehicles, and in this respect, the present invention addresses this need and interest.

SUMMARY OF THE INVENTION

In view of the foregoing disadvantages inherent in the known types of trays for use in vehicles now present in the prior art, the present invention provides an improved lap desk for use by children in automobile. As such, the general purpose of the present invention, which will be described subsequently in greater detail, is to provide a new and improved lap desk which has all the advantages of the prior art trays for use in vehicles and none of the disadvantages.

To attain this, a representative embodiment of the concepts of the present invention is illustrated in the drawings and makes use of a box-like frame which provides a planar writing surface. Further, the box-like frame is provided with a plurality of storage compartments covered by hinged doors for the storage of paper, coloring books, crayons, markers, etc. The lap desk of the present invention further makes use of straps for attaching the lap desk to automobile safety belts when in use. Another strap which passes beneath the legs of a child in a sitting position further secures the lap desk during use. An optional feature of the present invention is a removable pad which snaps to the bottom surface of the lap desk. The pad may be provided with a pair of trough like recesses for the reception of a child's legs. Other features contemplated for use in the present invention include: pencil grooves spaced on the periphery of the top surface of the lap desk, a spring type paper clip on the top surface of the lap desk and an upstanding circular holder for beverage containers. Another feature which may be provided in the lap desk of the present invention is a slightly slanted writing surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lap desk which has all the advantages of the prior art lap desks and none of the disadvantages.

It is another object of the present invention to provide a new and improved lap desk which may be easily and efficiently manufactured and marketed.

It is a further object of the present invention to provide a new and improved lap desk which is of a durable and reliable construction.

An even further object of the present invention is to provide a new and improved lap desk which is susceptible of a low cost of manufacture with regard to both materials and labor, and which accordingly is then susceptible of low prices of sale to the consuming public, thereby making such lap desks economically available to the buying public.

Still yet another object of the present invention is to provide a new and improved lap desk which provides in the apparatuses and methods of the prior art some of the advantages thereof, while simultaneously overcoming some of the disadvantages normally associated therewith.

Still another object of the present invention is to provide a new and improved lap desk which may be safely secured during use.

Yet another object of the present invention is to provide a new and improved lap desk which makes use of a removable pad to provide for the comfort of the user and to further stabilize the lap desk during use.

Even still another object of the present invention is to provide a new and improved lap desk which provides a safe and convenient entertainment center for use by children during extended automobile trips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
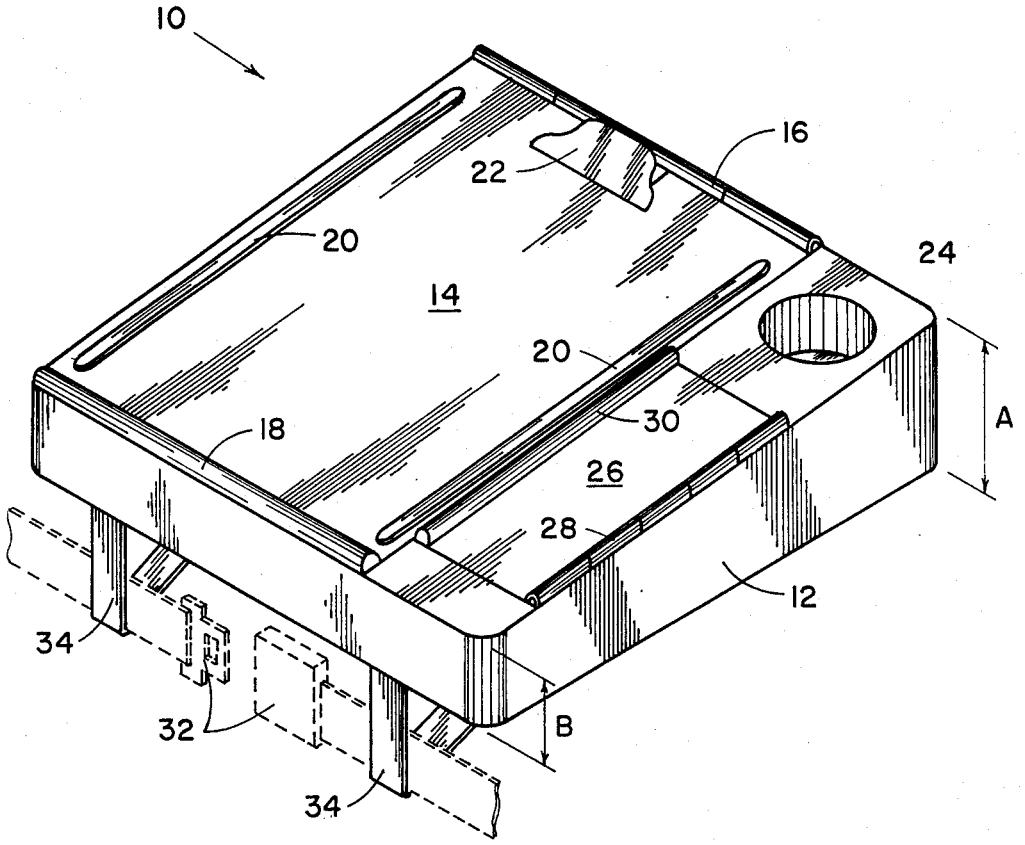
FIG. 1 is a perspective top view of the lap desk of the present invention.

With reference now to the drawings, and in particular to FIG. 1 thereof, a new and improved lap desk embodying the principles and concepts of the present invention and generally designated by the reference numeral 10 will be described.

More specifically, it will be noted that the first embodiment 10 of the invention includes a box-like frame 12. The frame 12 is tapered from top to bottom as illustrated by dimensional lines A and B. This provides a slightly slanted writing surface. The box-like frame 12 is provided with a first compartment having a door 14 connected to the box-like frame by a hinge 16. An upwardly standing ridge 18 is provided at a lower edge portion of the door 14. This ridge 18 serves as a handle for opening the door 14, and also serves as a stop to prevent crayons and markers from rolling off the top surface of the door 14 in use. Pencil grooves 20 are provided on either side of the top surface of door 14 to prevent crayons and markers from rolling off the sides of the writing surface. A spring type paper clip 22 is provided adjacent an upper edge portion of door 14. This spring clip 22 serves to maintain paper or coloring books in position during use. At an upper corner portion of the box-like frame 12, an upstanding beverage receptacle 24 is provided. This provides for a secure retention of beverage containers such as soda cans. A second compartment for the reception of crayons and markers has a door 26 connected to the box-like frame 12 by a hinge 28. A curved upstanding projection 30 serves as a handle for the opening of door 26. For the attachment of the lap desk 10 to conventional automobile safety belt 32 during use, a pair of attaching straps 34 are provided. These straps are mounted to the underside of the box frame 12 by conventional means such as snaps or VELCRO. These straps 34 serve to maintain the lap desk 10 secured in the event of a collision. A strap 36 is secured to the underside portion of the box-like frame 12. This strap 36, in use, is passed beneath the legs of a child in a seated position and fastens to the opposite side of the box frame 12. This prevents the lap desk 10 from flying up into the face of a child in the event of a collision.

Figure 2:
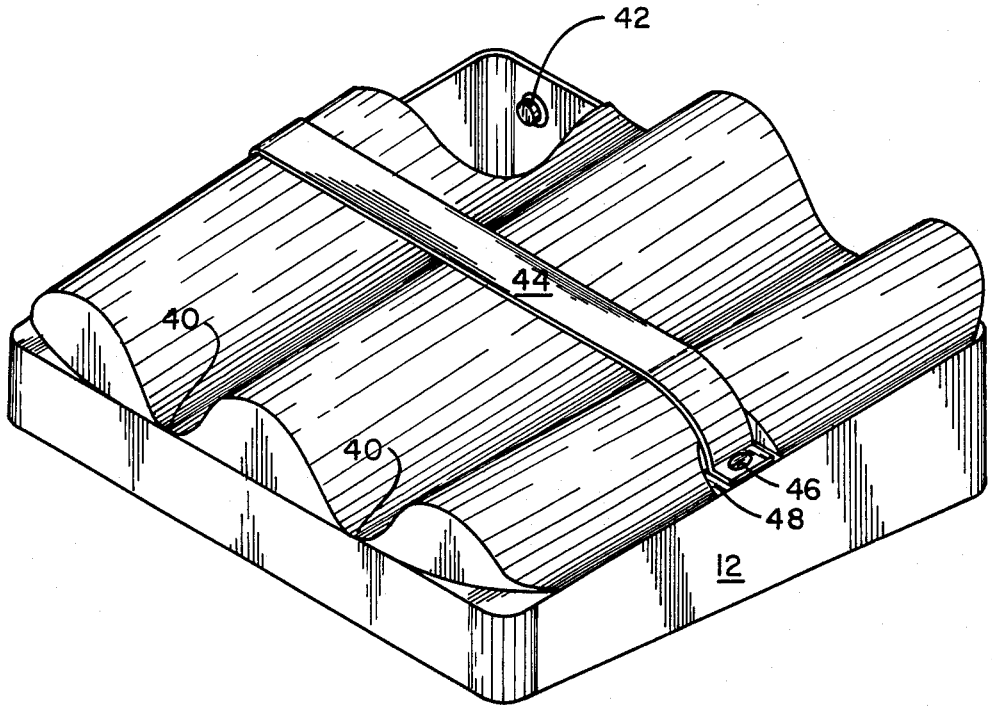
FIG. 2 is a perspective bottom view of the lap desk of the present invention, illustrating the removable pad.

With reference now to FIG. 2, a perspective view of the bottom side of the lap desk 10 of the present invention is illustrated. A pad 38 is removably attached to the bottom surface of the box-like frame 12. The pad is attached by conventional means such as by a plurality of spaced snaps 42, one of which is illustrated. The pad may also be attached by VELCRO. The pad 38 may be a flat planar surface, or preferably, may be contoured to provide a pair of spaced troughs for the reception of a child's legs. The pad 38 may be formed of a molded foam material to provide these troughs 40, or may be a pad filled with a stuffing of pellet like material which is formable into troughs 40. A leg strap 44 is attached to the bottom surface of the box frame 12 by conventional means such as snaps 46. Again, other conventional means such as VELCRO may be utilized. A pair of notches 48 are provided in the pad 38 to allow attachment of the leg strap 44 to the snaps 46 on the bottom surface of the box-like frame 12. Thus, in use, the lap desk 10 of the present invention rests on the lap of a child, with the upper surfaces of the legs of the child received in the troughs 40. Leg strap 44 passes beneath the legs of the child.

It is also to be noted that all edges and corners of the lap desk of the present invention are rounded. This is to ensure the safety of the user. The lap desk of the present invention is preferably formed of a molded plastic. This provides sufficient strength and rigidity, while being light in weight so as not to burden the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved lap desk, for use by a child in an automobile, comprising:

a box-like frame having a tapered thickness;

a first compartment in said frame;

a first door for said first compartment connected by a first hinge to a top upper edge of said frame;

a second compartment in said frame;

a second door for said second compartment connected by a second hinge to a top side edge of said frame;

said first and second hinges extending at a right angle;

an upstanding beverage receptacle formed on a top surface of said frame;

an elongated curved ridge projection for use as a handle, extending along an edge portion opposite said hinges of each of said first and second doors;

a spring paper clip attached to an upper edge portion of said first door, adjacent said first hinge;

a pair of straps, for attaching said lap desk to an automobile safety belt, each of said straps having both ends secured to a bottom surface of said frame, thereby forming a pair of loops;

a leg strap for securing said lap desk to the legs of a child during use, attached to a bottom surface of said frame;

a pad removably attached to a bottom surface of said frame;

said pad attached to the bottom surface of said frame by means of a plurality of spaced snaps;

said pad having a pair of notches formed at opposite side edges and said leg strap attached to a bottom surface of said frame by snaps through said notches.

* * * * *